US005938129A

United States Patent [19]

Forsyth

[11] Patent Number: 5,938,129

[45] Date of Patent: Aug. 17, 1999

[54] ROTARY MILLS

[76] Inventor: Rod Forsyth, #9 Maple Grove Trailer Court, Maple Creek, Saskatchewan, Canada, S0N 1N0

[21] Appl. No.: 08/851,063

[22] Filed: May 5, 1997

[51] Int. Cl.[6] ..... B02C 18/22

[52] U.S. Cl. ..... 241/49; 241/55; 241/57; 241/74; 209/283

[58] Field of Search ..... 241/55, 56, 73, 241/49, 50, 51, 74, 57; 209/281, 283

[56] References Cited

U.S. PATENT DOCUMENTS

| | | | |
|---|---|---|---|
| 1,608,183 | 11/1926 | Quante | 241/55 |
| 1,902,721 | 3/1933 | Reynolds | 241/55 |
| 2,026,426 | 12/1935 | Matejcik | 241/51 |
| 2,225,781 | 12/1940 | Hinerfeld | 241/49 |
| 4,101,080 | 7/1978 | Schmidt | 241/51 |
| 5,381,971 | 1/1995 | Rehmer | 241/55 |

FOREIGN PATENT DOCUMENTS

| | | |
|---|---|---|
| 1222234 | 5/1987 | Canada . |
| 2091954 | 9/1994 | Canada . |

*Primary Examiner*—Mark Rosenbaum
*Attorney, Agent, or Firm*—Andrew Hicks; Scott & Aylen

[57] ABSTRACT

The present invention relates to improvements in screen and blade assemblies for rotary mills as well as to the design of a rotary mill to promote air flow through the mill. A rotary mill incorporating these improvements has increased capacity and the ability to mill products such as rubber, coffee, meats, chemicals and herbs without detrimental effects on the quality of the milled product.

14 Claims, 4 Drawing Sheets

ROTARY MILLS

FIELD OF THE INVENTION

The present invention relates to improvements in screen and blade assemblies for rotary mills as well as to the design of a rotary mill to promote air flow through the mill. A rotary mill incorporating these improvements has increased capacity and the ability to mill products such as rubber, coffee, meats chemicals and herbs without detrimental effects on the quality of the milled product.

BACKGROUND OF THE INVENTION

Rotary mills are well known for milling grains and other products. In general, these mills introduce a coarse product into a milling chamber whereupon it is ground to a fine particle size between a hammer and a screen. After grinding, fine particles pass through the screen and the milled product is removed from the milling chamber.

In the past, while such rotary hammer mills are effective in producing milled product, they are limited in a number of ways with respect to the efficiency of milling. For example, a hammer mill grinds the product against the screen in order to pulverize the product to a sufficiently fine size that the product can pass through the screen. While this is effective in producing a uniform product, it is destructive to the screen requiring frequent replacement of the screen due to wear. In order to address this problem, past screens systems have been developed wherein the product, upon entry into the mill, is initially abraded against a solid surface called a wear strip prior to finer grinding against the fine screen.

Furthermore, the efficiency with which such a mill operates is dependent predominantly upon the passive diffusion of a small particle through the screen. This results in limited volumes being processed as a result of both ineffective passage of product through the screen by non-active means as well as increased temperature of the product. As a result of the passive diffusion of particles, there is a tendency for the temperature within the mill to rise, leading to potential product breakdown. In the case of grains, this may lead to a loss in nutritional value as well as to an increase in humidity within the mill which can cause gumming problems. Overheating may also cause the temperature in the milling room to increase uncomfortably.

Other limitations of past hammer mills include the difficulty and expense of replacing worn screen assemblies. Typically, the fine screen of a screen assembly having both a coarse and fine screen will experience faster wear requiring regular replacement of the fine screen. Past screen assemblies have been limited in the ease of replacement of the fine screen often requiring complete disassembly of the screen assembly to remove and replace a worn fine screen. Some screen assemblies waste screen material through unnecessary overlap. Furthermore, in the past, the wear strip has been attached to the mill which complicates its replacement particularly if it has been welded to the mill.

Still further, in a milling operation, small animals such as rodents such as mice may be attracted to the milling room and rotary mills because of the inevitable spillage of product. During shut-down of the milling room operations, rodents may attempt to enter a milling machine in search of food which, if undetected, will severely compromise the quality of product upon start-up.

In another but related area, after becoming worn, rubber vehicle tires are discarded, usually in designated tire dumps. As is well known, these tire dumps are ecologically damaging and wasteful. The ability to recycle these tires is limited in view of the multi-component structure of a tire and the difficulties in effectively utilizing the tire after use. The typical tire has a steel belted tread with rubber/nylon sidewalls. This construction presents significant difficulties for the potential re-cycling of the rubber in the tire.

Accordingly, there has been a need for rotary mills which address the above problems, namely improving product processing rates, minimizing screen wear, reducing the time required to remove screen assemblies from a mill and replacing the fine screen, which do not overheat the product and which do not result in gumming or clogging the screen assembly during operation.

Still further there has been a need for rotary mills which minimize the risk of animal or rodent entry and which may be used to effectively mill other products such as rubber from discarded tires.

In addressing these problems and, in particular, improving processing volumes, there has been a need for a mill having cutting knives designed to cut product as opposed to hammer or crush the product against a screen. In order to further promote higher processing volumes, there has been also been a need for a mill having cooling fins to promote cooling, product removal and an air-inflow system which prohibits rodent entry. Still farther, there has been a need for a mill designed for simplified maintenance wherein the screen assembly including a wear strip can be quickly and easily rotated within the mill or replaced without wasting screen material. There has also been a need for a mill which can be easily adapted for milling rubber.

Examples of previous devices and assemblies include Canadian patent application 2,091,954 in which a screen construction for a mill is described wherein a fine screen is supported by a coarse screen in order to reduce the flexibility of the screen. However, this machine is limited in the volume and types of material or product which can be processed. It is also has problems with respect to excessive heating of the product during grinding leading to a loss in nutritional value of the product.

Canadian patent 1,222,234 describes a mill producing a fine flour which addresses the dusting and dough problems of previous mills around the air intake in the door. The design of this air intake, however, is overly complex and still results in some spillage of product.

SUMMARY OF THE INVENTION

In accordance with the invention, a rotary mill is provided comprising:

- a milling chamber including a product entry region and product removal region separated by a screen assembly;
- a rotating cutting assembly within the product entry region for milling a product adjacent the screen assembly, the cutting assembly including a cutting arm with at least one cutting blade and cooling fin on the cutting arm, the at least one cutting blade and cooling fin adapted to promote air flow from the product entry region to the product removal region through the screen assembly.

In other embodiments, the cutting blades are serrated, reversible and/or rectangular. The invention also provides curved cooling fins to promote air flow through the screen assembly. In one embodiment, the cooling fins are aluminum to promote heat transfer away from the milled product.

In another embodiment, a screen assembly for a rotary mill is provided comprising:

cylindrical support screen having first and second ends, the first end adapted for seating and sealing engagement within a door flange of the rotary mill, the cylindrical support screen also having a plurality of coarse openings;

cylindrical wear strip having a screen end and a mounting end, the screen end attached to the second end of the cylindrical support screen, the mounting end of the cylindrical wear strip adapted for seating and sealing engagement within a mounting flange within the rotary mill;

an inwardly projecting lip on the screen end of the cylindrical wear strip, the inwardly projecting lip defining a groove between the inwardly projecting lip and cylindrical support screen;

fine screen adjacent the cylindrical support screen, the fine screen seated within the groove and attached to the coarse screen by a linking plate.

The invention also provides a process of milling rubber tires in a rotary mill having a product entry region and product recovery region, the rubber tires having side walls comprising the steps of:

a. cutting the side walls off the tires;

b. rough cutting the side walls of the tires into coarse pieces having dimensions of approximately 1–3 inches;

c. milling the coarse pieces in a rotary mill having a cutting assembly in accordance with claim 1, the rotary mill also having a coarse screen;

d. removing milled product from the product recovery region and allowing the milled product to settle;

e. separating nylon cord from pelletized rubber.

Preferably, the coarse screen has oblong openings with dimensions in the range of ½" by ⅛" wherein the oblong openings are perpendicular to cutting blades. Furthermore, the milling step c may be repeated, as required with a finer screen, in order to produce a finer product which is removed from the product recovery region.

In a specific embodiment, the invention provides a rotary mill comprising:

a milling chamber including a product entry region and product removal region separated by a screen assembly;

rotating cutting assembly within the product entry region for milling a product adjacent the screen assembly, the cutting assembly including a cutting arm adapted for rotation about a rotation axis, the cutting arm with at least one cutting blade and cooling fin on the cutting arm, the at least one cutting blade and cooling fin adapted to promote air flow from the product entry region to the product removal region through the screen assembly;

the screen assembly including:

cylindrical support screen having first and second ends, the first end adapted for seating and sealing engagement within a door flange of the rotary mill, the cylindrical support screen also having a plurality of coarse openings;

cylindrical wear strip having a screen end and a mounting end, the screen end attached to the second end of the cylindrical support screen, the mounting end of the cylindrical wear strip adapted for seating and sealing engagement within a mounting flange within the rotary mill;

an inwardly projecting lip on the screen end of the cylindrical wear strip, the inwardly projecting lip defining a groove between the inwardly projecting lip and cylindrical support screen;

fine screen adjacent the cylindrical support screen, the fine screen seated within the groove and attached to the coarse screen by a linking plate;

and air inflow ports between the product entry region and the exterior of the mill, the air inflow ports adapted to prevent animal entry into the milling chamber and minimize spillage of product, wherein the air inflow ports comprise a plurality of holes each having a diameter in the range of ¼" to ½" adjacent the rotation axis of the cutting arms.

BRIEF DESCRIPTION OF THE DRAWINGS

These and other features of the invention will be more apparent from the following description in which reference is made to the appended drawings wherein.

DETAILED DESCRIPTION OF THE INVENTION

Figure 1:
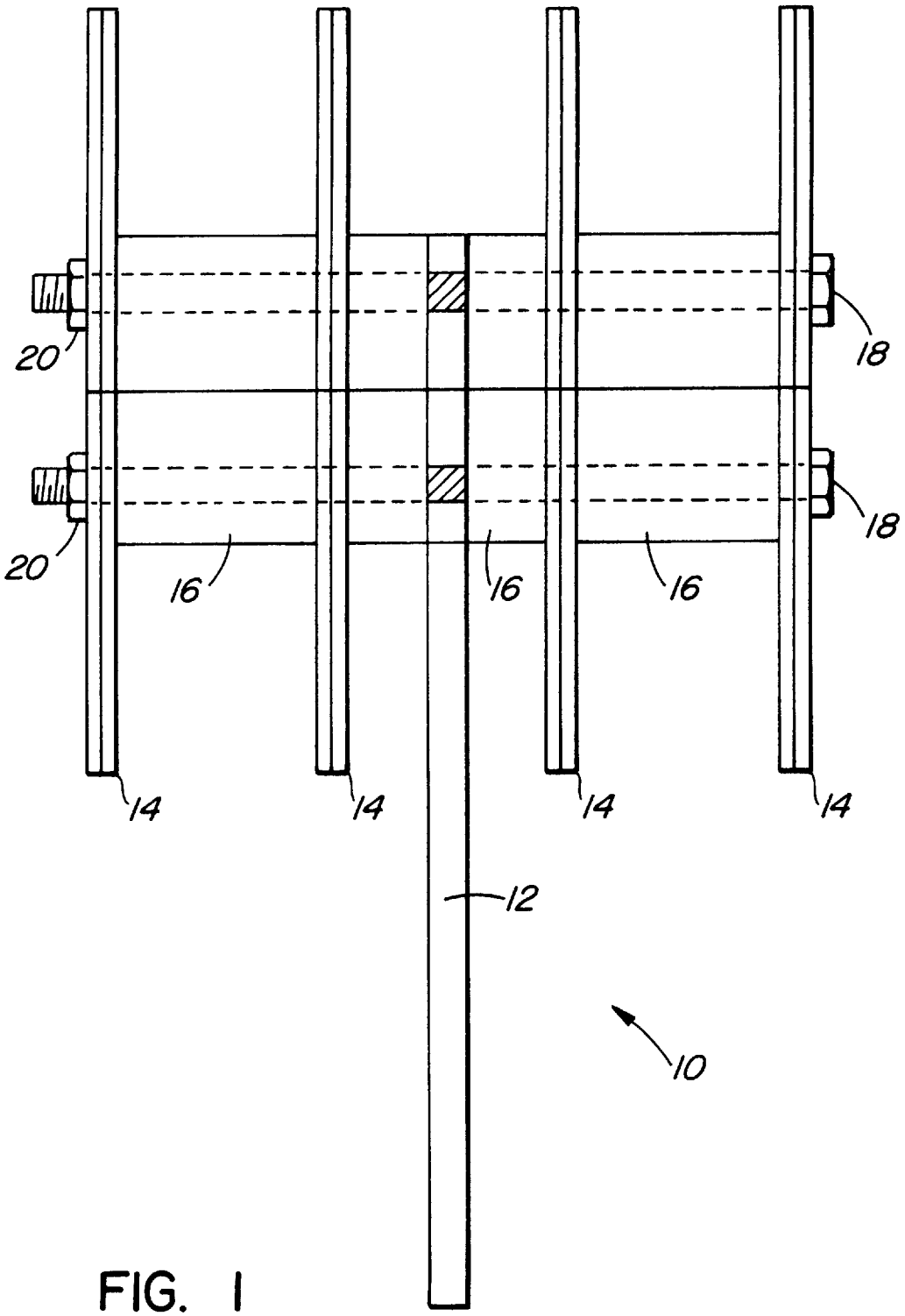
FIG. 1 is a top view of a cutting assembly in accordance with the invention.
Figure 2:
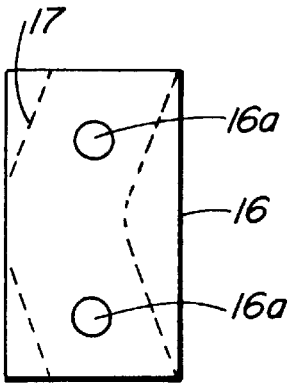
FIG. 2 is a side view of a cooling fin in accordance with the invention.
Figure 3:
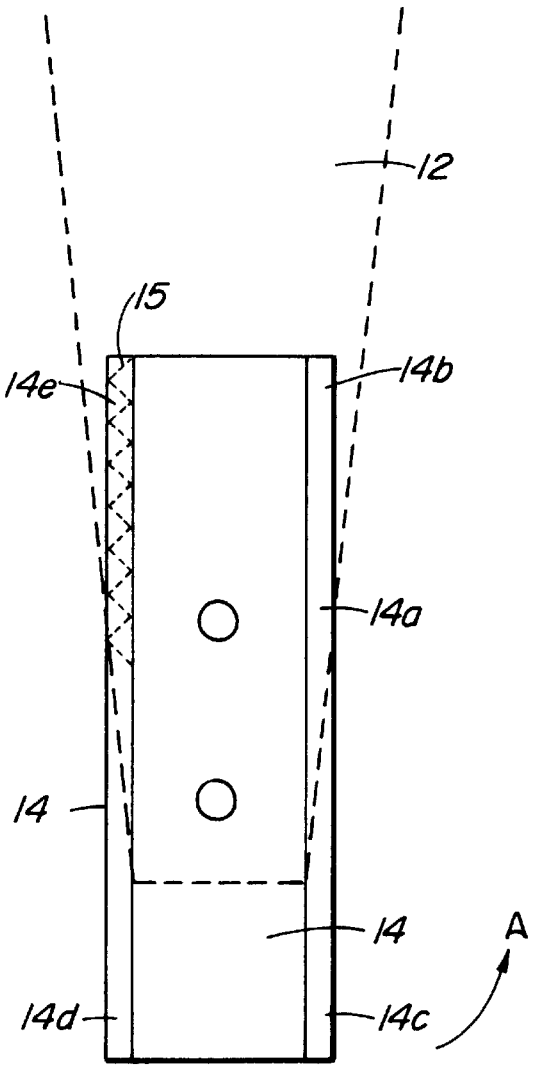
FIG. 3 is a side view of a cutting blade in accordance with the invention.
Figure 4:
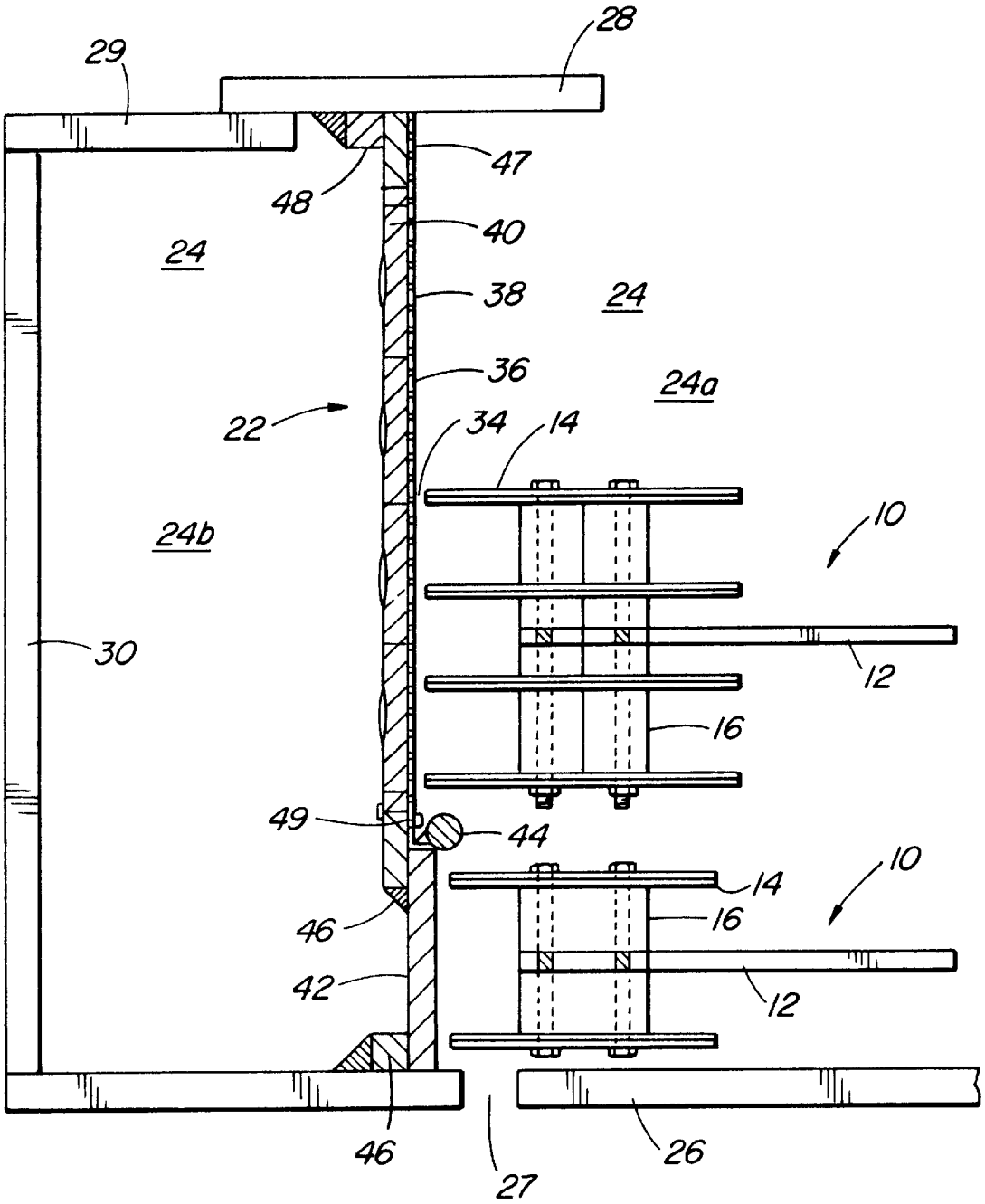
FIG. 4 is a cross-sectional view of a screen assembly and cutting blade assembly and a partial cross-sectional view of a rotary mill in accordance with the invention.

With reference to FIGS. 1–4, a cutting assembly 10 in accordance with the invention is shown. The cutting assembly 10 includes a rotating arm 12, cutting blades 14, cooling fins 16 and bolts 18 with nuts 20. As can be seen from FIG. 1, the cooling fins and cutting blades are assembled so that the cooling fins provide a spacing between the cutting blades 14. Preferably, a total of 4 blades are mounted at the end of the rotating arm 12, however, it is contemplated that either a single blade, two blades or any reasonable number of blades may be mounted thereon. FIG. 4 shows a rotating arm 12 with two and four blade cutting assemblies.

Figure 2A:
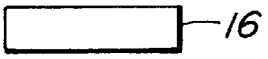
FIG. 2A is an end view of a cooling fin in accordance with the invention.

With reference to FIG. 2 and FIG. 2A, side and end views of a cooling fin 16 are shown, this particular cooling fin having a thickness relatively thinner than the length of the fin. This cooling fin comprises a simple plate 16 with holes 16*a* to allow the passage of bolts 18 therethrough. Within the scope of the invention, it is contemplated that while the simplest form of the cooling fin 16 may be a simple square or rectangular plate, other designs of cooling fin may be incorporated into the cutting assembly which promote the movement of air within the rotary mill. Such fins may be curved as shown by the dotted line 17 in FIG. 2 or any other suitable shape. Cooling fins 16 are preferably manufactured from a heat dissipating material, such as aluminum, in order to aid in the dissipation of heat which may build up in the product during milling.

Figure 3A:
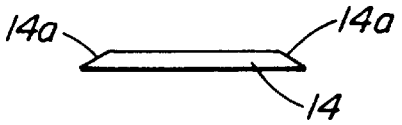
FIG. 3A is an end view of a cutting blade in accordance with the invention.
Figure 3B:
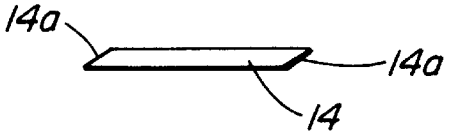
FIG. 3B is an end view of an alternative embodiment of a cutting blade in accordance with the invention.

With reference to FIG. 3, FIG. 3A and FIG. 3B, the cutting blades 14 are shown having a sharpened edge 14*a* for promoting the cutting of a substance within the mill. This design of the cutting blade 14 provides four separate cutting surfaces each of which can utilized to cut the product within the mill. In this regard, it should be noted that when assembled at the end of a cutting arm 12, the cutting assembly rotates in a consistent direction and hence, one region of the cutting blade 14 will be the predominant cutting surface. Accordingly, each region of the cutting edge 14*a* (designated 14*b,* 14*c,* 14*d,* and 14*e*) may be individually selected during assembly as the principal cutting edge. This design enables a rapid exchange of cutting blades 14 as a particular region of the blade becomes dull during use. Accordingly, for example, if the cutting arm 12 rotates in a direction designated A, the principal cutting region of the cutting blade 14 would be region 14*c*. Thus, as the region 14*c* becomes dull as a result of use, the operator may, upon removal of the cutting arm 12 from the mill, undo nuts 20, remove bolt 18 and choose one of the remaining regions (that is, either 14*b,* 14*d* or 14*e*) as the principal cutting region. For example, the cutting blade may be rotated in order that the 14*e* region is exchanged with the 14*c* region, or the blade may be flipped to exchange 14*c* with 14*d* or flipped and rotated to exchange 14*c* with 14*b*. In other embodiments of the cutting blades, the cutting blades may be serrated as shown in dotted lines at 15 to further promote the cutting ability of the blades. FIG. 3A and FIG. 3B show alternative embodiments of the cutting blade 14.

With reference to FIG. 4, a cutting assembly 10 and screen assembly 22 is shown within a milling chamber 24. The milling chamber 24 includes a product entry chamber 24*a* and a product removal chamber 24*b* defined by the back wall of the mill 26, the front door of the mill 28 and a side wall 30. The product entry chamber 24*a* is separated from the product recovery chamber 24*b* by the screen assembly 22. Generally, unmilled product is fed to the product entry chamber 24*a* through an entry port 27 whereupon the unmilled product encounters one or more rotating cutting assemblies 10 and is cut to a smaller size. During milling, the fine product, as it is produced, is forced through the screen assembly 22 to the product recovery chamber 24*b*. FIG. 4 shows a total of two separate cutting assemblies 10. It is, however, understood that the number of cutting assemblies 10 which are utilized will be dependent on the actual dimensions of a rotary mill.

Figure 4A:
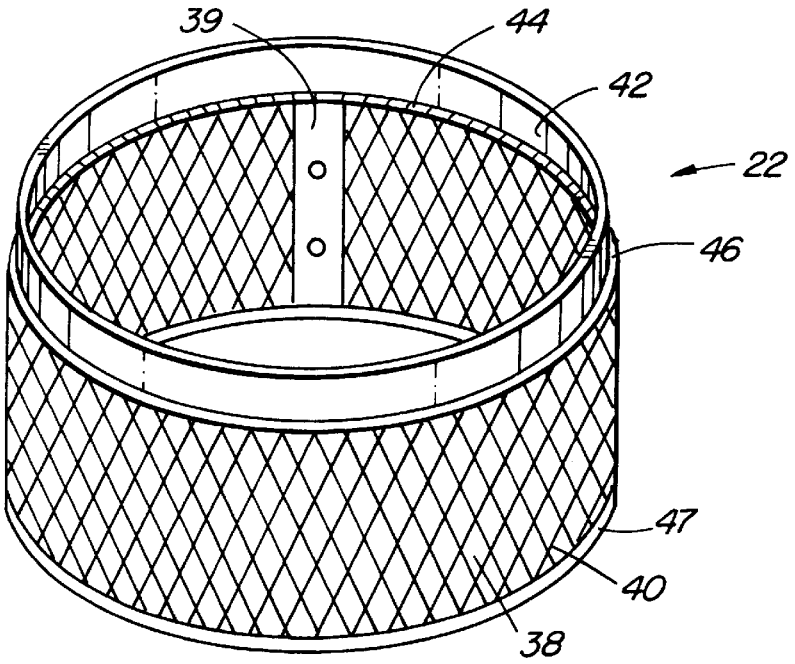
FIG. 4A is a perspective view of a screen assembly in accordance with the invention.

The screen assembly 22 is shown in cross-section in FIG. 4. FIG. 4A shows a perspective view of a typical screen assembly 22 including a wear strip. As can be seen from FIGS. 4 and 4A, the screen assembly is cylindrical having dimensions such that, when installed within a rotary mill, a clearance 34 exists between the cutting blade and inner surface 36 of the screen assembly 22. This clearance is typically ½" to ¼".

The screen assembly 22 includes a fine screen 38 supported by a coarse supporting screen 40 as well as a wear strip 42 with lip 44. Preferably, the wear strip 42 is welded to the coarse screen 40 at 46 thereby providing a rigid connection between the front and back regions of the screen assembly 22. The wear strip 42 is preferably a solid band of metal which does not include any screen-like openings. The screen assembly 22 also includes a lower band 47 attached to the coarse screen 40 to provide support to the lower end of the coarse screen 40.

The screen assembly 22 is designed in order to promote placement and removal of the screen assembly 22 within the mill. Preferably, the rear of the mill is provided with a circular flange 46 which supports and seals the screen assembly 22 against the back surface 26 of the mill. Furthermore, a circular flange 48 is provided on the door of the mill which also supports and seals the screen assembly 22 within the mill when the door 28 is closed. In an alternative embodiment, the screen assembly 22 may be assembled without a wear strip for milling softer products such as rubber or meat. In this case, the coarse screen 40 is provided with the appropriate band of metal to facilitate placement of the screen assembly within the mill.

The fine screen 38 includes a link plate 39 for joining two ends of fine screen 38 and for attaching the fine screen 38 to the coarse screen 40. This design of coarse and fine screen assembly minimizes the amount of material required for a screen assembly 22 and provides flexibility particularly for replacement as the coarse and fine screens may be readily separated from one another in order to facilitate replacement of a worn fine screen. In this regard, a fine screen may be readily removed from the coarse screen by removal of the link plate 39. Fine screen is then removed from the assembly and a new piece of fine screen is cut to size and configured to the coarse screen. Initially, the new fine screen is seated within groove 49 and pressed against the coarse screen 40. Link plate 39 is re-attached to the coarse screen thereby firmly holding and locking the fine screen against the coarse screen.

In operation, the cutting assembly 10 rotates within the milling chamber at high speed. Product enters the product entry chamber at the back wall 26 through product entry port 27 whereupon it encounters a first cutting assembly 10 adjacent the wear strip 42. At this position, the product is coarse and if allowed to come into contact with the fine screen, may damage the fine screen. Accordingly, the lip 44 is provided to initially retain the coarse material in the wear strip region thereby reducing the risk of coarse particles entering the fine screen region and damaging the screen. Upon entering the screen region, the product encounters the second cutting assembly whereupon it is cut to a fine particle size and continuously blown against the screen by the cooling fins. The product is expelled through the fine and coarse screens into the product recovery chamber 24*b*.

The cutting assembly in accordance with the invention permits a higher processing volume as a result of higher air flows and lower temperatures within the milling chamber. In this regard, the cooling fins 16 create a higher air flow adjacent the screen thereby forcing the product through the fine screen 36 at a higher rate than a cutting assembly without cooling fins. In this regard, the cooling fins are acting as fan blades to move a higher volume of air through the screen. This results in a cooler product and reduces the risk of gumming or clogging of the fine screen by an overheated product.

Figure 5:
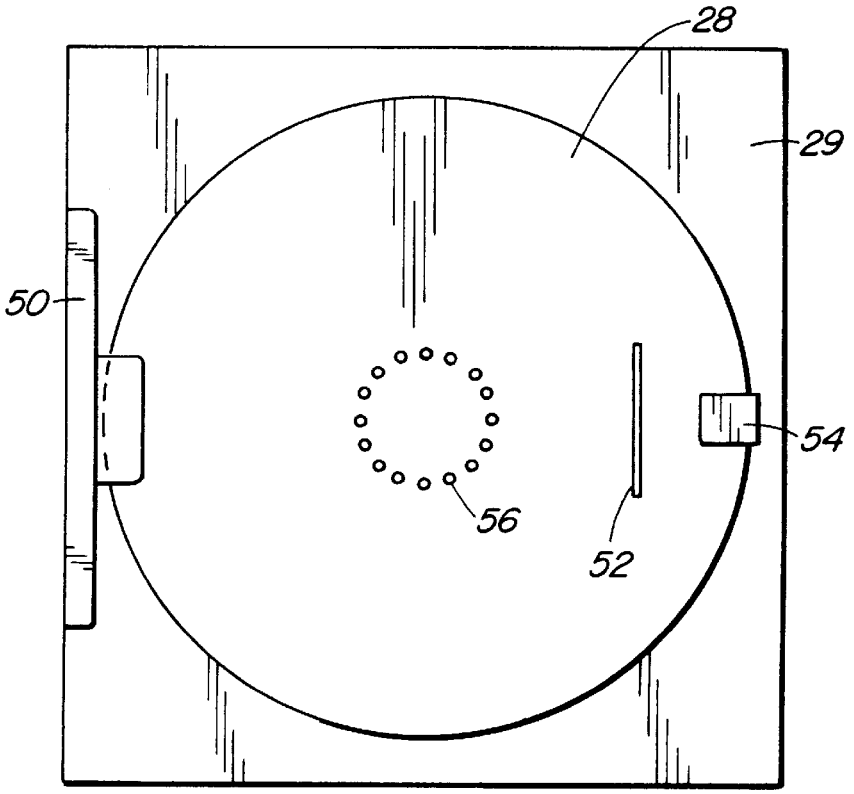
FIG. 5 is an end view of mill with an air intake in accordance with the invention.

With reference to FIG. 5, a front view of a typical mill door is shown including the front wall 29, mill door 28, hinge 50, handle 52 and latch 54. The mill door 28 is also provided with a plurality of air inflow holes which allow air to enter the milling chamber during operation of the mill. The location and size of the holes minimizes product spillage and eliminates the risk of animal or rodent entry into the milling chamber while the mill is shut-down. Typically, the holes are arranged in a circular pattern near the axis of rotation of the cutting arms of the mill wherein each hole has a diameter in the order of ½" to ¼". The holes are located near the centre of the door to promote radial air flow within the milling chamber. A sufficient number of holes are provided in order that adequate airflow is permitted into the milling chamber while also enhancing a venturi effect within each hole. With a series of holes which develop a significant venturi effect, minimal spillage is experienced during operation and as the mill is shut-down. The holes are also sufficiently small to prevent animal or rodent entry into the milling chamber.

A number of test runs incorporating the above improvements were performed as summarized in Table 1. Test runs 1–6 were performed utilizing a cutting assembly having cooling fins in accordance with the invention while test run 7 utilized a cutting assembly which replaced the cooling fins with round spacers. Test runs 1, 2 and 7 utilized flat bars (hammers) whereas test runs 3–6 utilized sharp cutting blades. Test runs 1–3 and 6 and 7 milled wheat whereas run 4 milled flax and run 5 milled dry silage. As can be seen from Table 1, significant advantages are realized with the improved cutting assembly.

Specifically, with respect to the effect of cooling fins on product temperature, test runs 1–6 did not exceed 75° F. whereas test run 7, where the cutting assembly did not include cooling fins but round spacers, exceeded 90° F.

Furthermore, a comparison of the effect of flat bars vs. cutting blades on capacity showed that the capacity of test runs 1, 2 and 7 was lower than that of test run 3 thereby demonstrating the effectiveness of the cutting blades in improving capacity.

Still further, the use of a cutting assembly with cooling fins and sharp blades in accordance with the invention resulted in a 20% increase in air flow through the mill door as compared to a cutting assembly utilizing round washers thereby demonstrating the effectiveness of the cooling fins on air flow, product volume and product temperature.

TABLE 1

| Test Run # | Blade Spacers | Blades | Product | Screen | Motor (Amps) | Capacity (lbs/hr) | Temp (° F.) |
|---|---|---|---|---|---|---|---|
| Test Run 1 | Cooling Fins | ¼" Flat Bars | Wheat | Fine .02 | 19.5 | 150 | Below 75° |
| Test Run 2 | Cooling fins | 3/16" Flat Bars | Wheat | .02 | 19.5 | 180 | Below 75° |
| Test Run 3 | Cooling Fins | Sharp Bars | Wheat | .02 | 19.5 | 225 | Below 75° |
| Test Run 4 | Cooling Fins | Sharp Bars | Flax | Oblong ⅛" × ½" vertical | 11 | 900 | Below 75° |
| Test Run 5 | Cooling Fins | Sharp Bars | Dry Silage | .02 | 8 | | Below 75° |
| Test Run 6 | Cooling Fins | Sharp Bars | Wheat | Oblong ⅛" × ½" vertical | | | Below 75° |
| Test Run 7 | Round Washers | 3/16" Flat Bars | Wheat | 0.02 | 19.5 | 180 | >90° |

Further tests of the improved cutting assembly with non-food products were conducted. The mill's effectiveness for milling rubber was investigated, specifically with the intention of providing a method of destroying used tires with the view to re-cycling the rubber contained therein. In this test, the side walls of a worn tire were cut from the tread of the tire and cut into rough pieces of approximate 1–3 inches in size for feeding the mill feed auger. A screen having approximately ⅛" by ½" oblong openings was used as the fine screen. After entry into the machine, the rubber was effectively milled to a granular product with particle sizes of approximately ⅛" diameter. No gumming or excessive temperature rise was observed. Still further, it was noted that the coarse rubber pieces which were fed to the mill contained nylon fibre. After passing through the mill, the nylon was separated from the pelletized rubber appearing as a fine wool-like cover over the denser rubber after settling. By passing a rake over the rubber, the nylon was easily removed from the milled rubber pellets.

Other products such as coffee, meats, chemicals or herbs may also be milled at cooler temperatures and at an increased capacity utilizing the improvements of the invention.

The terms and expressions which have been employed in this specification are used as terms of description and not of limitations, and there is no intention in the use of such terms and expressions to exclude any equivalents of the features shown and described or portions thereof, but it is recognized that various modifications are possible within the scope of the claims.

The embodiments of the invention in which an exclusive property or privilege is claimed are defined as follows:

1. A rotary mill comprising:

a milling chamber including a product entry region and product removal region separated by a screen assembly;

rotating cutting assembly within the product entry region for rotation about a rotation axis and for milling a product adjacent the screen assembly, the cutting assembly including a cutting arm with at least one cutting blade and cooling fin mounted at the distal end of the cutting arm, the at least one cutting blade and cooling fin adapted to promote air flow through the screen assembly.

2. A rotary mill as in claim 1 wherein the cutting blades are serrated.

3. A rotary mill as in claim 2 wherein the cutting blades are reversible.

4. A rotary mill as in claim 3 wherein the cooling fins are rectangular and include four cutting regions.

5. A rotary mill as in claim 4 wherein the cooling fins are curved to promote air flow through the screen assembly.

6. A rotary mill as in claim 5 wherein the cooling fins are aluminum.

7. A rotary mill as in claim 1 wherein the cutting blades are reversible.

8. A rotary mill as in claim 1 wherein the cooling fins are rectangular and include four cutting regions.

9. A rotary mill as in claim 1 wherein the cooling fins are curved to promote air flow through the screen assembly.

10. A rotary mill as in claim 1 wherein the cooling fins are aluminum.

11. A rotary mill as in claim 1 wherein the rotary mill includes air inflow ports through the milling chamber adjacent the rotation axis.

12. A screen assembly for a rotary mill comprising:

cylindrical support screen having first and second ends, the first end adapted for seating and sealing engagement within a door flange of the rotary mill, the cylindrical support screen also having a plurality of coarse openings;

cylindrical wear strip having a screen end and a mounting end, the screen end attached to the second end of the cylindrical support screen, the mounting end of the cylindrical wear strip adapted for seating and sealing engagement within a mounting flange within the rotary mill;

an inwardly projecting lip on the screen end of the cylindrical wear strip, the inwardly projecting lip defining a groove between the inwardly projecting lip and cylindrical support screen;

fine screen adjacent the cylindrical support screen, the fine screen seated within the groove and attached to the coarse screen by a linking, plate.

13. A rotary mill comprising:

a milling chamber including a product entry region and product removal region separated by a screen assembly;

rotating cutting assembly within the product entry region for milling a product adjacent the screen assembly, the cutting assembly including a cutting arm adapted for rotation about a rotation axis, the cutting arm with at least one cutting blade and cooling fin on the cutting arm, the at least one cutting blade and cooling fin adapted to promote air flow from the product entry region to the product removal region through the screen assembly;

the screen assembly including: cylindrical support screen having first and second ends, the first end adapted for seating and sealing engagement within a door flange of the rotary mill, the cylindrical support screen also having a plurality of coarse openings;

cylindrical wear strip having a screen end and a mounting end, the screen end attached to the second end of the cylindrical support screen, the mounting end of the cylindrical wear strip adapted for seating and sealing engagement within a mounting flange within the rotary mill;

an inwardly projecting lip on the screen end of the cylindrical wear strip, the inwardly projecting lip defining a groove between the inwardly projecting lip and cylindrical support screen;

fine screen adjacent the cylindrical support screen, the fine screen seated within the groove and attached to the coarse screen by a linking plate;

and air inflow ports between the product entry region and the exterior of the mill, the air inflow ports adapted to prevent animal entry into the milling chamber and minimize spillage of product, wherein the air inflow ports comprise a plurality of holes each having a diameter in the range of ¼" to ½" adjacent the rotation axis of the cutting arms.

14. A rotary mill comprising:

a milling chamber including a product entry region and product removal region separated by a screen assembly;

rotating cutting assembly within the product entry region for milling a product adjacent the screen assembly, the cutting assembly including a cutting arm between at least two cutting blades, the cutting blades separated by a cooling fin for promoting air flow and product flow through the screen assembly, the cutting blades and cooling fin mounted at the distal end of the cutting arm.

* * * * *